US006166654A

United States Patent [19]

Van Den Steen

[11] Patent Number: 6,166,654

[45] Date of Patent: Dec. 26, 2000

[54] DRILLING ASSEMBLY WITH REDUCED STICK-SLIP TENDENCY

[75] Inventor: Leon Van Den Steen, Rijswijk, Netherlands

[73] Assignee: Shell Oil Company, Houston, Tex.

[21] Appl. No.: 09/061,773

[22] Filed: Apr. 16, 1998

[30] Foreign Application Priority Data

Apr. 11, 1997 [EP] European Pat. Off. ..... 97201096

[51] Int. Cl.[7] ..... G01V 3/00

[52] U.S. Cl. ..... 340/853.6; 340/853.3; 73/152.47

[58] Field of Search ..... 340/853.3, 853.6; 175/27, 26, 40, 325.1, 56; 367/25; 73/152.47

[56] References Cited

U.S. PATENT DOCUMENTS

| | | | |
|---|---|---|---|
| 3,703,096 | 11/1972 | Vitter | 73/152 |
| 5,117,926 | 6/1992 | Worrall | 175/56 |
| 5,277,061 | 1/1994 | Draoui | 73/152.47 |
| 5,358,059 | 10/1994 | Ho | 175/45 |
| 5,377,161 | 12/1994 | Meehan | 367/82 |
| 5,448,911 | 9/1995 | Mason | 73/152.47 |
| 5,507,353 | 4/1996 | Pavone | 175/27 |
| 5,560,439 | 10/1996 | Delwiche | 175/325.1 |
| 5,704,436 | 1/1998 | Smith | 175/27 |
| 5,721,376 | 2/1998 | Pavone | 73/152.47 |
| 5,842,149 | 11/1998 | Harrell | 702/9 |
| 5,852,235 | 12/1998 | Pavone | 73/152.45 |
| 5,864,058 | 1/1999 | Chen | 73/152.47 |

FOREIGN PATENT DOCUMENTS

| | | | |
|---|---|---|---|
| 0 443 689 A2 | 8/1991 | European Pat. Off. | E21B 41/00 |

*Primary Examiner*—Michael Horabik
*Assistant Examiner*—Albert K. Wong

[57] ABSTRACT

A system for drilling a borehole in an earth formation is disclosed, the system comprising a first sub-system including a drill string extending into the borehole, and a second sub-system including a drive system for driving the drill string in rotation about the longitudinal axis thereof. Each one of said sub-systems has a rotational resonance frequency, wherein the rotational resonance frequency of the second sub-system is lower than the rotational resonance frequency of the first sub-system.

11 Claims, 1 Drawing Sheet

DRILLING ASSEMBLY WITH REDUCED STICK-SLIP TENDENCY

FIELD OF THE INVENTION

The invention relates to a system for drilling a borehole in an earth formation.

BACKGROUND OF THE INVENTION

In a commonly applied method of wellbore drilling, referred to as rotary drilling, a drill string is rotated by a drive system located at surface. The drive system generally includes a rotary table or a top drive, and the drill string includes a lower end part of increased weight, i.e. the bottom hole assembly (BHA) which provides the necessary weight on bit during drilling. By a top drive is meant a drive system which drives the drill string in rotation at its upper end, i.e. close to where the string is suspended from the drilling rig. In view of the length of the drill string, which is in many cases of the order of 3000 m or more, the drill string is subjected to considerable elastic deformations including twist around its longitudinal axis whereby the BHA is twisted relative to the upper end of the string. Each of the rotary table, the top drive and the BHA has a certain moment of inertia, therefore the elastic twist of the drill string leads to rotational vibrations resulting in considerable speed variations of the drill bit at the lower end of the string. One particularly unfavourable mode of drill string behaviour is stick-slip whereby the rotational speed of the drill bit cyclicly decreases to zero, followed by increasing torque of the string due to continuous rotation by the drive system and corresponding accumulation of elastic energy in the drill string, followed by coming loose of the drill string and acceleration up to speeds significantly higher than the nominal rotational speed of the drive system.

The large speed variations induce large torque variations in the drill string, leading to adverse effects such as damage to the string tubulars and the bit, and a reduced rate of penetration into the rock formation.

To suppress the stick-slip phenomenon, control systems have been applied to control the speed of the drive system such that the rotational speed variations of the drill bit are damped. One such system is disclosed in EP-B-443 689, in which the energy flow through the drive system of the drilling assembly is controlled to be between selected limits, the energy flow being definable as the product of an across-variable and a through-variable. The speed fluctuations are reduced by measuring at least one of the variables and adjusting the other variable in response to the measurement.

It is an object of the invention to provide a system for drilling a borehole in an earth formation, which system has a reduced tendency of stick-slip of the drill string in the borehole.

SUMMARY OF THE INVENTION

In accordance with the invention there is provided a system for drilling a borehole in an earth formation, comprising

- a first sub-system including a drill string extending into the borehole; and
- a second sub-system including a drive system for driving the drill string in rotation about the longitudinal axis thereof, each of said sub-systems having a rotational resonance frequency, wherein the rotational resonance frequency of the second sub-system is lower than the rotational resonance frequency of the first sub-system.

DETAILED DESCRIPTION

It is to be understood that in the present context the rotational resonance frequencies of each sub-system is considered to be the rotational resonance frequency of the sub-system in isolation, i.e. when the sub-system is not influenced by the other sub-system.

By the feature that the rotational resonance frequency of the second sub-system is lower than the rotational resonance frequency of the first sub-system, it is achieved that the drive system performs a harmonic motion lagging behind the harmonic motion of the drill string, particularly behind the BHA. Such performance creates beats in the system, which tend to reduce the oscillation.

In practice of the invention the rotational resonance frequency of the first subsystem depends on the moment of inertia of the bottom hole assembly, and the rotational resonance frequency of the second sub-system depends on the moment of inertia of the rotary table or the top drive, whichever one is used.

Generally the drive system includes an electronic control device which controls the rotation of the drill string. In practice of the invention the rotational resonance frequency of the second sub-system suitably depends on the tuning of such electronic control device so that the rotational resonance frequency of the second sub-system is controlled by the electronic control device.

To ensure that the harmonic motion of the second sub-system remains out of phase with the harmonic motion of the first sub-system it is preferred that the rotational resonance frequency of the second sub-system is higher than half the rotational resonance frequency of the first sub-system.

Optimal damping behaviour is achieved when the rotational resonance frequency of the second sub-system is such that a selected threshold rotational velocity of the bottom hole assembly, below which threshold velocity stick-slip oscillation of the bottom hole assembly is possible, is substantially at a minimum. Generally the drilling assembly has a plurality of rotational vibration modes, each mode having a corresponding threshold rotational velocity below which stick-slip oscillation of the bottom hole assembly can occur. Optimal damping is then achieved if the largest of the threshold rotational velocities corresponding to said modes is minimised.

Figure 1:
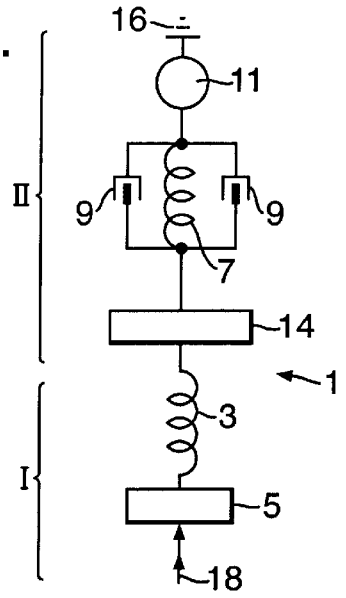
FIG. 1 schematically shows a rotational vibration system representing a drilling assembly for drilling a borehole in an earth formation.

Referring to FIG. 1 there is shown a schematic representation of a drilling system 1 which includes a first sub-system I with a drill string 3, here shown as a torsional spring, extending into a borehole and a bottom hole assembly (BHA) 5 forming a lower part of the drill string 3, and a second sub-system II in the form of a drive system arranged to rotate the drill string about the longitudinal axis thereof. The drive system includes a motor 11 driving a rotary table 14 which in turn rotates the drill string 3. The drive system is further represented by a parallel arrangement of a torsional spring 7 and a torsional viscous damper 9. In practice of the invention the torsional spring 7 and torsional viscous damper 9 are simulated by an electronic control system (not shown) regulating the speed of the motor 11. The motor housing is fixedly connected to a support structure 16. Furthermore, a drill bit (not shown) is arranged at the lower end of the drill string, which drill bit is subjected to frictional forces inducing a torsional moment 18 to the drill bit.

In the schematic representation of FIG. 1 the BHA has a moment of inertia $J_1$, the drill string 3 has a torsional spring constant $k_2$, the rotary table 14 has a moment of inertia $J_3$, the viscous damper 9 has a damping ratio $c_f$, and the torsional spring 7 has a torsional spring constant $k_f$.

During normal operation of the system 1 the motor 11 rotates the rotary table 14 and the drill string 3 including the BHA. The torsional moment 18 acting on the drill bit counters the rotation of the string. The system 1 has two degrees of freedom with respect to rotational vibration and in its linear range, when no stick-slip occurs and the motion can be regarded as free damped response, it will have two resonant modes. One way of tuning the system 1 is to improve the damping of the mode with the smallest damping ratio. However it was found that improving the damping of one mode goes at the expense of the damping of the other mode. In view thereof it has been previously proposed that the system is optimally damped if both modes assume the same damping ratio. This occurs at the following conditions:

$$k_f=k_2 \cdot J_3/J_1 \quad (1)$$

$$c_f=2\sqrt{(k_2 \cdot J_3)} \quad (2)$$

It is convenient to introduce dimensionless parameters as follows:

$$\beta=c_f/2\sqrt{(k_f \cdot J_1)} \quad (3)$$

$$\nu=\sqrt{(k_f \cdot J_1/k_2 \cdot J_3)} \quad (4)$$

$$\mu=J_1/J_3 \quad (5)$$

wherein $\beta$ denotes the viscous damping provided by the electronic feedback system;

$\nu$ denotes the ratio of the resonance frequencies of the two sub-systems when considered independent from each other; and $\mu$ denotes the ratio of the two moments of inertia.

For the situation that both resonant modes have the same damping ratio it follows from substitution of eqs. (1), (2) into eqs. (3), (4), (6) that $\beta=1$, and $\nu=1$.

For a given drilling assembly the parameter $\mu$ is the only parameter which cannot be freely changed to optimise the tuning, hence the only tuning parameters are $\beta$ and $\nu$, both being functions of $\mu$.

In the case of $\nu=1$ it follows that the resonant frequencies of both modes are the same. This implies that following a torque perturbation at the drill bit, both the BHA 5 and the rotary table 14 perform motions largely in synchronisation with each other. A problem of such tuning is the comparatively high threshold rotary velocity for stick-slip motion, which threshold velocity may well extend into the lower operational drilling range and allows detrimental stick-slip oscillation of the drill string to occur. This leads to reduced rate of penetration and enhanced drill string wear as explained above.

Figure 2:
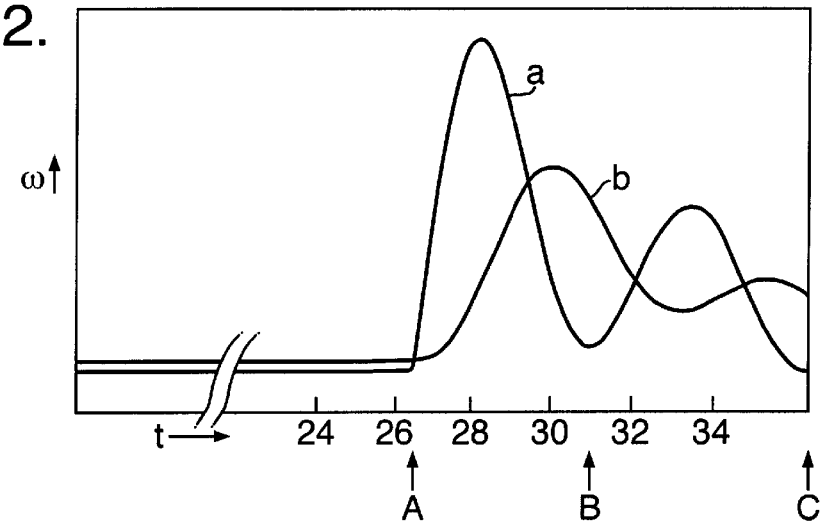
FIG. 2 schematically shows a diagram indicating harmonic rotary behaviour of the BHA and the rotary table using the system of the invention.

Referring to FIG. 2, the drilling system of FIG. 1 has been tuned such that the rotational resonance frequency of the second sub-system is lower than the rotational resonance frequency of the first sub-system. It is thereby achieved that the drive and the rotary table perform a damped harmonic motion lagging behind the motion of the BHA. Curve a denotes the rotary speed ($\Omega$) of the BHA as a function of time ($\tau$(s)), and curve b denotes the rotary speed of the rotary table as a function of time. As it is well-known that increasing the rotary speed of the string ultimately causes the stick-slip phenomenon to vanish, the rotary speed has been selected at the threshold of stick-slip such that an infinitesimally small increase of the rotary speed causes the stick-slip oscillation to vanish which is visible from the minimum of the BHA velocity just reaching zero (point C). Following a period of sticking, the BHA comes loose at point A on the time scale due to the continuous rotation of the rotary table. The BHA then performs a cycle of increasing and decreasing speed, reaches a minimum greater than zero at point B, and performs another cycle which ends at a minimum of zero at point C. The rotary table develops a phase lag due to $\nu<1$. This causes the rotary table to swing in substantially opposite motion with respect to the BHA, and the resulting twist of the drill string prevents the BHA at point B from reaching zero speed. If this would not have been so, the threshold rotational speed for stick-slip would have been higher. Only at point C the BHA speed reaches zero again, however, by then considerable vibrational energy has been absorbed. As a result the threshold velocity for stick-slip motion is considerably below that when the BHA would have reached zero speed after one cycle.

It will be appreciated that the system of FIG. 1 generally has a non-linear dynamic behaviour due to the non-linear friction at the drill bit, whereby the torsional friction moment 18 depends on the BHA velocity. In general such non-linearity causes the system to have more than two rotational vibration modes, each mode having a corresponding threshold rotational velocity of the BHA, below which threshold velocity stick-slip oscillation of the BHA occurs. The tuning parameters $\beta$ and $\nu$ have been selected such that the largest of the threshold rotational velocities corresponding to said modes, is minimised. The values thus obtained for $\beta$ and $\nu$ are shown in the diagram of FIG. 3 in which the solid lines connect the points actually found for optimal values of $\beta$ and $\nu$ as a function $\mu$ and the dashed lines represent polynomial fits through the points actually found.

Figure 3:
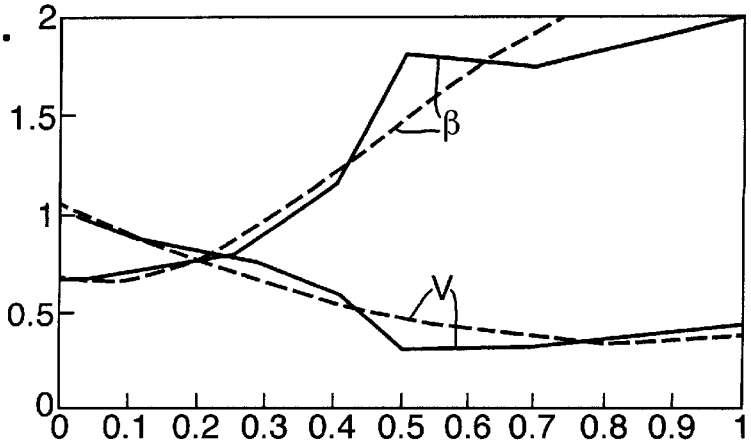
FIG. 3 schematically shows a diagram indicating optimal values of tuning parameters for reducing stick-slip behaviour.

In agreement with the curves shown in FIG. 3, it was found that preferred values for $\beta$ and $\nu$ in order to achieve optimally reduced stick-slip behaviour are:

generally $\beta$ to be between 0.5–1.1; more specifically $\beta$ to be between 0.5–0.8 for the parameter $\mu$ being between 0.0–0.2;

$\beta$ to be between 0.7–1.1 for the parameter $\mu$ being between 0.2–0.4;

generally $\nu$ to be between 0.5–1.1; more specifically $\nu$ to be between 0.7–1.1 for the parameter $\mu$ being between 0.0–0.2; and $\nu$ to be between 0.5–0.8 for the parameter $\mu$ being between 0.2–0.4.

Instead of a rotary table, a top drive can be applied to rotate the drill string. In that case $J_3$ is the moment of inertia of a rotating drive member of the top drive.

I claim:

1. A system for drilling a borehole in an earth formation, comprising a first sub-system including a drill string extending into the borehole; and a second sub-system including a drive system for driving the drill string in rotation about the longitudinal axis thereof, each of said sub-systems having a rotational resonance frequency, wherein the rotational resonance frequency of the second sub-system is lower than the rotational resonance frequency of the first sub-system.

2. The system of claim 1, wherein the rotational resonance frequency of the second sub-system is higher than half the rotational resonance frequency of the first sub-system.

3. The system of claim 1, wherein the rotational resonance frequency of the second sub-system is such that a selected threshold rotational velocity of the bottom hole assembly, below which threshold velocity stick-slip oscillation of the bottom hole assembly occurs, is substantially at a minimum.

4. The system of claim 3, wherein the drilling assembly has a plurality of rotational vibration modes, each mode having a corresponding threshold rotational velocity of the bottom hole assembly, below which threshold velocity stick-slip oscillation of the bottom hole assembly occurs, and wherein said selected threshold rotational velocity is the largest of the threshold rotational velocities corresponding to said modes.

5. The system of claim 1, wherein the parameter $\beta$ as defined hereinbefore, has a magnitude of between 0.5–1.1.

6. The system of claim 5, wherein $\beta$ has a magnitude of between 0.5–0.8 if the parameter $\mu$, as defined hereinbefore, has a magnitude of between 0.0–0.2.

7. The system of claim 5, wherein $\beta$ has a magnitude of between 0.7–1.1 if the parameter $\mu$, as defined hereinbefore, has a magnitude of between 0.2–0.4.

8. The system of claim 1, wherein the parameter $\nu$, as defined hereinbefore, has a magnitude of between 0.5–1.1.

9. The system of claim 8, wherein $\nu$ has a magnitude of between 0.7–1.1 if the parameter $\mu$, as defined hereinbefore, has a magnitude of between 0.0–0.2.

10. The system of claim 8, wherein $\nu$ has a magnitude of between 0.5–0.8 if the parameter $\mu$, as defined hereinbefore, has a magnitude of between 0.2–0.4.

11. The system of claim 1, wherein the drive system includes an electronic control device controlling the rotation of the drill string, and the rotational resonance frequency of the second sub-system is controlled by the electronic control device.

* * * * *